United States Patent [19]

Fridsma

[11] Patent Number: 4,878,348

[45] Date of Patent: Nov. 7, 1989

[54] TURBINE GOVERNOR VALVE MONITOR

[75] Inventor: Daniel E. Fridsma, Winter Springs, Fla.

[73] Assignee: Westinghouse Electric Corp., Pittsburgh, Pa.

[21] Appl. No.: 250,198

[22] Filed: Sep. 28, 1988

[51] Int. Cl.[4] ..... F01K 13/02

[52] U.S. Cl. ..... 60/660; 60/646

[58] Field of Search ..... 60/646, 660, 657, 662

[56] References Cited

U.S. PATENT DOCUMENTS 3,934,419 1/1976 Aanstad ..... 60/660

4,461,152 7/1984 Tennichi et al. ..... 60/660

OTHER PUBLICATIONS

"Turbine Control Valve Alignment and Position Monitoring Procedures", by S. E. Williams, EPRI Power Plant Performance Monitoring and System Dispatch Improvement Workshop, Nov. 12–14, 1986.

*Primary Examiner*—Stephen F. Husar

*Attorney, Agent, or Firm*—K. Bach

[57] ABSTRACT

A method and apparatus for continually monitoring the operating state of a set of governor valves (42,60) in a steam supply system for the first stage of a high pressure turbine during operation of the turbine, the system including a source including a throttle valve (40) for supplying steam at a defined pressure to the governor valves (42,60) and a plurality of nozzles (44) each connected to deliver steam from a respective governor valve (42,60) to a respective turbine inlet region, by the steps of: monitoring (52) the pressure at the outlet of each governor valve (42,60); monitoring (50,54) the pressure at the inlet to the throttle valve(s) (40) and at the turbine first stage; and comparing (56) the monitored outlet pressure of each governor valve (42,60) with the monitored pressure at the throttle valve inlet and at the turbine first stage in order to provide an indication of the operating state of each governor valve (42,60) and to detect and alert power plant operators of valve malfunctions or inefficient operation.

8 Claims, 3 Drawing Sheets

TURBINE GOVERNOR VALVE MONITOR

BACKGROUND OF THE INVENTION

The present invention relates to a method and apparatus for monitoring the positions and operating sequence of turbine governor valves, particularly in a turbine-generator system, and determining malfunctions or inefficiencies therein.

The flow of driving steam to a turbine is generally regulated by governor valves via which steam is delivered from a high-pressure steam source to the inlet nozzles of a high-pressure turbine stage. Since the turbine stage generally has a plurality of nozzles distributed around its circumference, a separate governor valve is provided for supplying steam to each nozzle. Depending on the operating requirements of the particular turbine system, all valves can be controlled to operate in unison or in a certain sequence.

Each valve can operate between a fully closed state and a fully open state. When a governor valve which is initially fully closed is to begin passing steam, it is usually caused to jump immediately to approximately 7 percent of its total displacement, or lift. The valve is then said to be at its crack point. There is usually a small amount of play in the valve plug and the valve stem must move through a small distance before the valve "cracks" and begins to pass steam.

Then, as the valve stem continues to be displaced in the opening direction, flow through the valve increases approximately linearly until a further point is reached, known as the knee point. During this portion of valve displacement, the valve is controlling, or modulating, steam flow. The knee point, which usually occurs after the valve has been displaced over 30–40 percent of its total path, corresponds to the establishment of nearly full flow through the valve. A valve is usually controlled so that upon reaching its knee point, it is moved to the open end of its displacement path.

A regular increase in flow occurs as the valve closing element is moved from its crack point to its knee point and the knee point represents the point at which an abrupt increase occurs in the slope of the displacement vs. flow curve.

If the desired control of flow of steam to the high-pressure turbine stage requires that a governor valve operate in the region between its crack point and knee point, steam flowing through the partly opened valve is being throttled by the valve, which has an adverse effect on the efficiency of the high-pressure turbine and on the heat rate of the power plant.

Turbine-generator load is a function of a steam flow which, in turn, is a function of turbine governor valve position. Turbine governor valves can be operated in two modes: single valve mode (in which all governor valves move in unison) and sequential valve mode (in which the governor valves operate individually in a preset sequence). At loads less than full load, sequential valve mode operation is more efficient than single valve mode operation. In sequential valve mode, the most efficient turbine operation is achieved at a valve point. A valve point is defined as the point at which a governor valve is open as much as possible before the next valve in sequence begins to open. There are several distinct valve points depending on the number of governor valves. Operation between valve points is inefficient because of steam throttling losses through partially open governor valves. This is sometimes unavoidable due to utility dispatch load requirements. This is called operating on a valve loop because of the "loop" in the heat rate curve between valve points. Operating on a valve loop can cause heat rate losses of up to 50 Btu/kWh.

The pressure conditions associated with sequential valve operation are depicted in the curve of FIG. 1, which represents the relation between pressure and flow or load percent with respect to each valve. This diagram relates to a system employing six governor valves, two of which operate in unison and the other four of which operates sequentially for supplying steam to the first stage, or high-pressure stage, of a multistage turbine. Steam is supplied to all of the governor valves via throttle valves whose inlet pressures remain essentially constant, as shown by the horizontal broken line in FIG. 1. The pressure with which steam is supplied to the first turbine stage is also shown.

Curve 10 represents the outlet pressure of the first two valves which are to be opened as the turbine begins operation in the lower point of its load range. These valves can be controlled from their fully closed condition, corresponding to turbine shutdown, to their fully opened condition, corresponding to knee point 12. When the first two valves reach their knee point, at which they are supporting nearly their full flow, and all of the other valves remain essentially closed, the turbine is operating at its lowest valve point.

If the turbine is to operate at a higher load level, the next valve in the sequence is opened; the variation in outlet pressure of that valve as it opens from its crack point 14 to its knee point 16 is represented by curve 18. When the valves represented by curves 10 and 18 are passing their full flow, the turbine is operating at the next valve point.

Correspondingly, the operating the level of the turbine can be increased by opening one or more of the next three valves in sequence, for which the pressure variations between crack points 20, 22 and 24, and knee points 26, 28 and 30 are represented by curves 32, 34 and 36, respectively.

The outlet pressures of the valves which are already fully open are represented generally by the common curve 37, which represents a pressure differing from the throttle valve inlet pressure by an amount 38 constituting the pressure drop across the throttle valve and the open governor valves for each load value. The vertical distance between the curve representing the outlet pressure of each governor valve and the first stage pressure corresponds essentially to the pressure drop across the associated nozzle which is supplied with steam via the valve.

In systems employing sequential valve actuation, it is desirable that a certain overlap 39 exist between the load point associated with the knee point of one valve and the load point associated with the crack point of that valve which is to open next in the sequence if the load is increasing, or which closed previously in the sequence if the load is decreasing. If such overlap does not exist, then a "flat spot" will appear in the load response, and this can be source of operating instability. On the other hand, an excessive overlap creates an inefficient operating condition.

In addition, when sequential valve operation is employed, it is important that the valves be operated in a sequence such that steam is supplied to the turbine stage over only a single contiguous portion of its nozzle circumference. If steam were supplied at two angularly separated portions of the nozzle circumference, with no steam being supplied between those portions, this would produce a condition known as double shock which can place severe stresses on the turbine stage and may lead to blade failure in a short period of time. While such condition should not occur if the governor valves are operating properly, it could occur due to breakage of a governor valve stem.

It is known to monitor turbine governor valve alignment on the basis of measurements of throttle pressure, throttle temperature and first stage pressure. Such an approach is described, for example, in a publication entitled *EPRI first use, document FS5429B/E,* published in December 1985.

It is also known to employ governor valve outlet pressure readings to set governor valve points during field tests.

SUMMARY OF THE INVENTION

It is an object of the present invention to promptly detect and warn power plant operators of governor valve malfunctions and to assist them in achieving the most efficient valve settings.

Another object of the invention is to monitor the operating sequence of governor valves on a continuing basis in order to assure that the desired overlap exists between valves which operate in succession to one another.

The above and other objects are achieved, according to the present invention, by a method and apparatus for continually monitoring the operating state of a set of governor valves in a steam supply system for a high pressure turbine during operation of the turbine, the system including a source for supplying steam at a defined pressure to the governor valves and a plurality of nozzles each connected to deliver steam from a respective governor_valve to a respective turbine nozzle region. The invention is implemented by: monitoring the pressure at the outlet of each governor valve; monitoring the pressure at the inlet of the throttle valve(s) and at the turbine first stage; and comparing the monitored outlet pressure of each valve with the monitored pressure at the throttle valve inlet and at the turbine first stage in order to provide an indication of the operating state of each governor valve.

DESCRIPTION OF THE PREFERRED EMBODIMENTS

According to the invention, the outlet pressure ($P_{vi}$, where i is the number of the valve in terms of the order in which it operates) of each governor valve is directly monitored by a pressure transducer, as are the pressure, $P_{Thr}$, at the throttle valve inlet and the pressure, $P_{fs}$, at the turbine first stage. These readings are processed arithmetically to derive, for each governor valve, a representation of $P_{Thr}-P_{vi}$ and $P_{vi}-P_{fs}$.

If $P_{Thr}-P_{vi}$ is less than a selected first threshold value, and remains at that value for a selected time period, it can be concluded that governor valve i is open. Generally, the first threshold valve will be slightly greater than the anticipated pressure drop from the point where $P_{Thr}$ is measured, through the open governor valve, to the point where $P_{vi}$ is measured.

On the other hand, if $P_{vi}-P_{fs}$ is less than a second selected threshold value, which will be considerably smaller than the first threshold value, and remains at that value for a selected time period, it can be concluded that valve i is closed.

The governor valve outlet pressure values when the valve is open or closed are substantially equal to the knee point pressure, $P_{kni}$, and crack point pressure, $P_{cri}$, respectively, and are stored as current knee point and crack point pressure values.

The above-mentioned stored values for $P_{kni}$ and $P_{cri}$ are retained until new values are noted when one of the difference values occurs, which new values are then stored. These values will change, for example, when the operating point of the turbine is varied.

Whenever the governor valves are operating properly, such that they would open in the sequence, $V_1$, $V_2$, ... $V_i$ ... $V_n$ and close in the sequence $V_n$ ... $V_i$ ... $V_2$, $V_1$, then at any given time each valve between $V_1$ and $V_i$ will be at $P_{kn}$, each valve between $V_n$ and $V_i$ will be at $P_{cr}$, and valve i may be at either $P_{kn}$ or $P_{cr}$ or a value therebetween if valve i is in the active part of its operating range.

Therefore, the outlet pressures of the governor valves can be easily compared to determine the existence of fault conditions, such as a double shock condition or a broken valve stem.

The readings associated with governor valves which operate in succession with one another can be compared to determine whether they are operating with the proper overlap.

Figure 1:
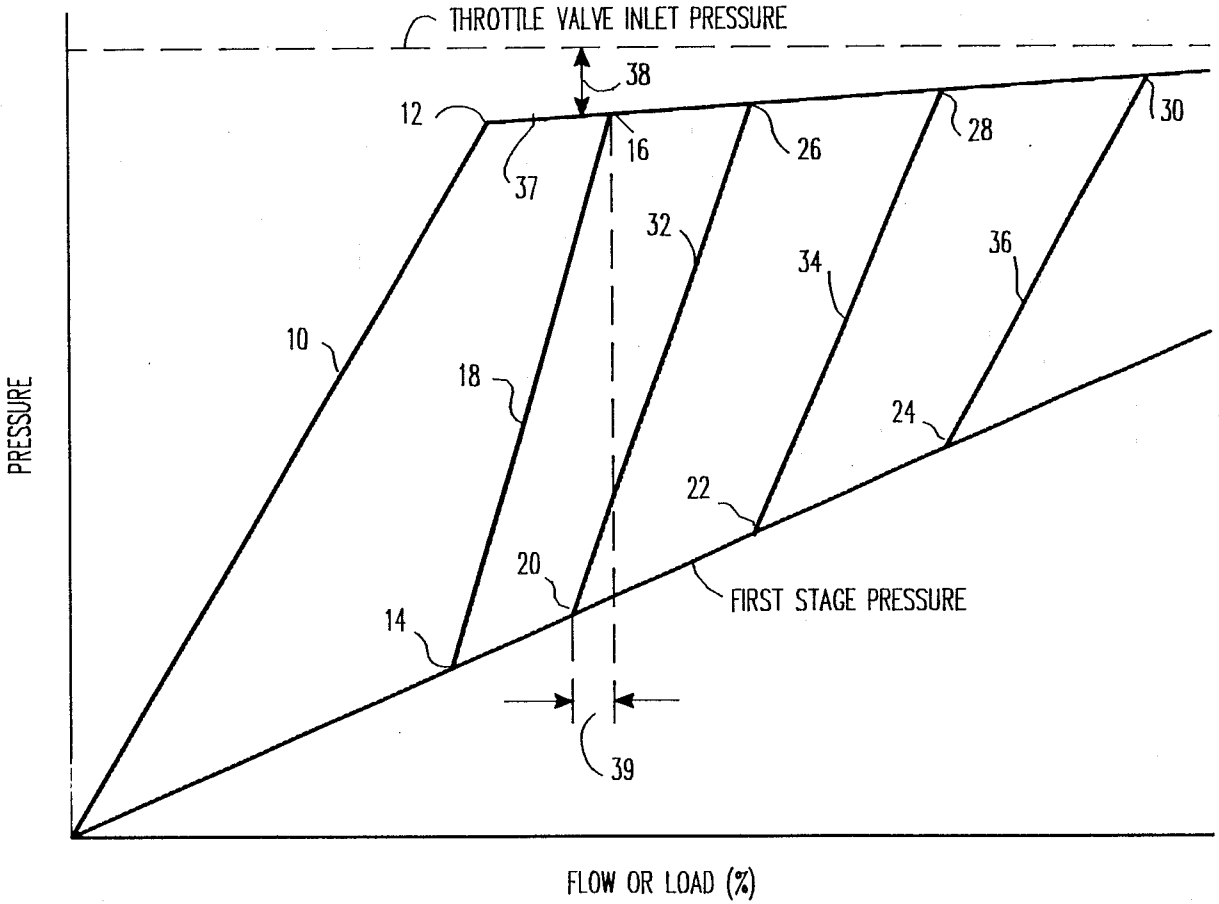
FIG. 1 is a diagram illustrating sequential governor valve operation in a turbine stage steam supply system.
Figure 2:
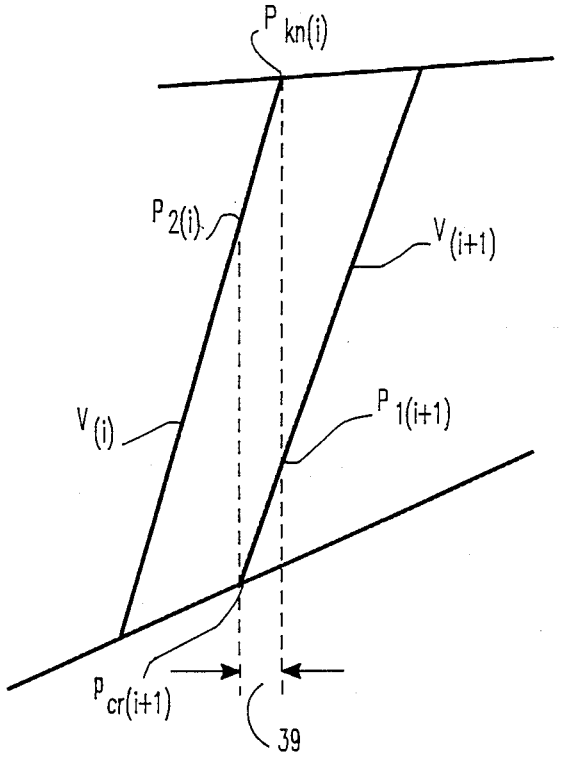
FIG. 2 is a diagram illustrating the operating characteristics of two sequentially operated governor valves.

FIG. 2 illustrates the curves of valve outlet pressure vs. flow, or turbine load, for two governor valves, $V_{(i)}$ and $V_{(i+1)}$, which operate in succession. When every output pressure reading for valve $V_{(i)}$ which is between $P_{kn(i)}$ and one reference value, $P_{2(i)}$, coincides in time with an output pressure reading for valve $V_{(i+1)}$ which is between $P_{cr(i+1)}$ and another reference, value, $P1(i+1)$, the overlap between valves $V_1$ and $V_{(i+1)}$ is in the normal range.

If an output pressure reading for valve $V_{(i)}$ which is between $P_{kn(i)}$ and $P_{2(i)}$ coincides with an output pressure reading for valve $V_{(i+1)}$ which is greater than $P_{1(i+1)}$, or an output pressure reading for valve $V_{(i+1)}$ which is between $P_{cr}(i+1)$ and $P_1(i+1)$ coincides with an output pressure reading for valve $V_i$ which is less than $P_{2(i)}$, it can be concluded that an excess valve overlap exists.

Finally, if an output pressure reading for valve $V_i$ of $P_{kn(i)}$ coincides with an output reading for valve $V_{(i+1)}$ of $P_{cr(i+1)}$, it can be concluded that a flat spot condition exists.

The criteria described above have the advantage of being time-independent; for a given observation, all pressures must be monitored simultaneously, but successive observations need be made only at a sufficient rate to assure that a faulty condition will be promptly detected.

It is alternatively possible to detect such conditions by sampling each pressure at a suitable rate, storing successive readings to derive a pressure variation pattern whenever a valve resetting operation is initiated, and then comparing the patterns of successively operated valves relative to a given time scale in order to identify the above-described conditions.

Figure 3:
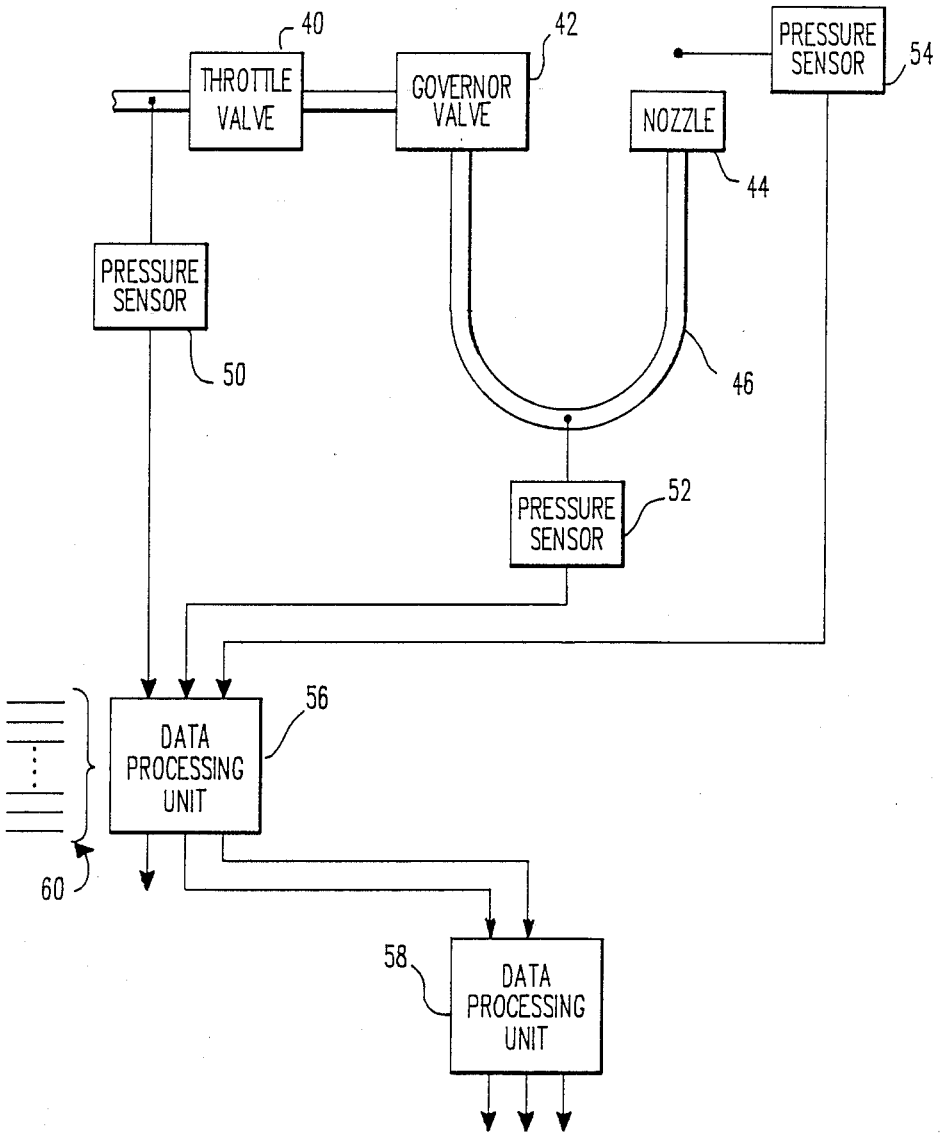
FIG. 3 is a block diagram of apparatus for implementing the present invention.

FIG. 3 illustrates one steam supply path to a turbine high pressure stage together with monitoring components and devices for implementing the invention. In order to supply steam to the high pressure stage, steam under pressure is delivered to a throttle valve 40. The steam leaving throttle valve 40 is delivered to a plurality of governor valves 42, one of which is depicted in FIG. 3. Valve 42 supplies steam to a respective nozzle 44 via a conduit 46.

A first pressure sensor 50 is disposed for monitoring the inlet pressure to throttle valve 40, while a second pressure sensor 52 is disposed in tube 46 to monitor the outlet pressure of valve 42, and a third pressure sensor 54 is disposed for monitoring the pressure in the turbine first stage. If conduit 46 has a U-shaped configuration, sensor 52 may be disposed at the lowest point thereof.

The pressure readings of sensors 50, 52 and 54 are supplied to a first data processing stage 56 which compares the various pressure readings in the manner described earlier herein and provides output signals indicative of whether governor valve 42 is open or closed, as well as signals indicating the current values of $P_{kn}$ and $P_{cr}$ of valve 42. Unit 56 also receives similar signals from sensors associated with other governor valves 60. Unit 56 compares the readings associated with each governor valve in a repetitive manner and generates output signals indicative of the position and $P_{kn}$ and $P_{cr}$ values for each governor valve individually.

The output signals from unit 56, together with the sensor signals, are passed to a further processing unit 58. Unit 58 compares the signals associated with all the governor valves and generates output signals indicative of the relation among the valves as concerns their operating states, sequence, and the degree of overlap between valves which operate in succession to one another.

While the present invention enables a full range of monitoring functions to be performed on the basis of the pressure readings described above, these readings could be combined with additional inputs to produce further information.

For example, data regarding the intended position of each governor valve, derived from the mechanism employed to set each governor valve, could be compared with valve position information derived from the various pressure signals to produce an indication of whether each governor valve is currently at the intended position. Furthermore, malfunction indications derived in the manner described above could be facilitated or confirmed, and other types of malfunctions could be detected, by combining the data derived from the pressure readings with other turbine data including, for example: the electrical output of a generator driven by the turbine; the electrical demand on which the turbine load setting is based; throttle valve temperature readings; digital valve test data; and digital single valve mode data.

The present invention could, of course, be applied to systems which operate in the single valve mode, particularly to detect the existence of a double shock condition.

The data derived according to the present invention can be displayed in various formats according to principles known in the art, to provide operators with malfunction information.

While the description above shows particular embodiments of the present invention, it will be understood that many modifications may be made without departing from the spirit thereof. The pending claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A method of continually monitoring the operating state of a set of governor valves in a steam supply system for the first stage of a high pressure turbine during operation of the turbine, the system including means including a throttle valve for supplying steam at a defined pressure to the governor valves and a plurality of nozzles each connected to deliver steam from a respective governor valve to a respective turbine inlet region, comprising: monitoring the pressure at the outlet of each governor valve; monitoring the pressure at the inlet to the throttle valve and at the turbine first stage; and comparing the monitored outlet pressure of each governor valve with the monitored pressure at the throttle valve inlet and at the turbine first stage in order to provide an indication of the operating state of each governor valve.

2. A method as defined in claim 1 wherein said step of comparing comprises producing indications of the magnitude of the difference between the monitored outlet pressure of each governor valve and each of the monitored pressure at the throttle valve inlet and the monitored pressure at the turbine first stage, and comparing each difference indication with a respective threshold value.

3. A method as defined in claim 2 wherein the governor valves are operated in a selected sequence to effect a change in the steam flow to the turbine, and further comprising comparing the indications of the operating states of all governor valves in order to verify that operation is occurring in the selected sequence.

4. A method as defined in claim 2 wherein: each governor valve has a valve closing element movable between a first end state in which the governor valve is closed and a second end state in which the governor valve is open; the governor valves are operated in a selected sequence to effect a change in the steam flow to the turbine in such a manner that the valve closing element of one governor valve is caused to move from one of the end states when the valve closing element of the preceding governor valve in the sequence is at a selected distance from, and moving toward, the other one of the end states; and further comprising comparing the monitored outlet pressures of the one governor valve and the next governor valve in the sequence in order to provide an indication of the position of the valve closing element of the one governor valve in the sequence when the valve closing element of the preceding governor valve is at a location which is between the other one of the end states and the selected distance from the other one of the end states.

5. Apparatus for continually monitoring the operating state of a set of governor valves in a steam supply system for the first stage of a high pressure turbine during operation of the turbine, the system including means including a throttle valve for supplying steam at a defined pressure to the governor valves and a plurality of nozzles each connected to deliver steam from a respective governor valve to a respective turbine inlet region, comprising: means disposed for monitoring the pressure at the outlet of each governor valve; means disposed for monitoring the pressure at the inlet to the throttle valve and at the turbine first stage; and means connected to said monitoring means for comparing the monitored outlet pressure of each governor valve with the monitored pressure at the throttle valve inlet and at the turbine first stage in order to provide an indication of the operating state of each governor valve.

6. Apparatus as defined in claim 5 wherein said means for comparing comprises means for producing indications of the magnitude of the difference between the monitored outlet pressure of each governor valve and each of the monitored pressure at the throttle valve inlet and the monitored pressure at the turbine first stage, and means for comparing each difference indication with a respective threshold value.

7. Apparatus as defined in claim 6 wherein the governor valves are operated in a selected sequence to effect a change in the steam flow to the turbine, and further comprising means for comparing the indications of the operating states of all governor valves in order to verify that operation is occurring in the selected sequence.

8. Apparatus as defined in claim 6 wherein: each governor valve has a valve closing element movable between a first end state in which the governor valve is closed and a second end state in which the governor valve is open; the governor valves are operated in a selected sequence to effect a change in the steam flow to the turbine in such a manner that the valve closing element of one governor valve is caused to move from one of the end states when the valve closing element of the preceding governor valve in the sequence is at a selected distance from, and moving toward, the other one of the end states; and further comprising means for comparing the monitored outlet pressures of the one governor valve and the next governor valve in the sequence in order to provide an indication of the position of the valve closing element of the one governor valve in the sequence when the valve closing element of the preceding governor valve is at a location which is between the other one of the end states and the selected distance from the other one of the end states.

* * * * *